US006135066A

United States Patent [19]

Matsuto et al.

[11] Patent Number: 6,135,066

[45] Date of Patent: Oct. 24, 2000

[54] WATER-COOLED FOUR CYCLE ENGINE

[75] Inventors: Takushi Matsuto; Kaoru Wachigai; Keiichiro Niizuma; Toshio Yamamoto, all of Saitama, Japan

[73] Assignee: Honda Giken Kogyo Kabushiki Kaisha, Tokyo, Japan

[21] Appl. No.: 09/152,106

[22] Filed: Sep. 14, 1998

[30] Foreign Application Priority Data

Sep. 14, 1997 [JP] Japan ..... 9-268076
Sep. 14, 1997 [JP] Japan ..... 9-268078

[51] Int. Cl.[7] ..... F01P 5/10

[52] U.S. Cl. ..... 123/41.44

[58] Field of Search ..... 123/41.44, 41.47, 123/41.48; 417/411

[56] References Cited

U.S. PATENT DOCUMENTS

| | | | |
|---|---|---|---|
| 2,497,402 | 2/1950 | Findley | 123/41.44 |
| 4,934,342 | 6/1990 | Tamba et al. | 123/184.32 |
| 5,809,960 | 9/1998 | Hojyo et al. | 123/184.32 |
| 5,836,270 | 11/1998 | Aoki et al. | 123/41.31 |
| 5,881,682 | 3/1999 | Hirose et al. | 122/26 |

FOREIGN PATENT DOCUMENTS

| | | |
|---|---|---|
| 215758 | 5/1973 | Germany . |
| 62-029794 | 2/1987 | Japan . |
| 8-175477 | 7/1996 | Japan . |
| 08303242 | 11/1996 | Japan . |

*Primary Examiner*—Marguerite McMahon
*Assistant Examiner*—Jason Benton
*Attorney, Agent, or Firm*—Birch, Stewart, Kolasch & Birch, LLP

[57] ABSTRACT

To provide a compact water-cooled four cycle engine suitable for a hybrid type power unit. The tension of a belt is increased by loosening bolts, turning an eccentric tube fitting, and moving a common pulley. After the tension of the belt is thus adjusted, the bolts are fastened. A water pump, which is supported by a shaft portion fitted in a guide groove and by the two bolts, are not moved except for the step of adjusting the tension of the belt 122. Since the tensioner serves as the pump pulley, it is possible to reduce the number of pulleys and hence to simplify the layout of the pulleys and reduce the number of parts. In accordance with another aspect of the present invention, a thermostat is mounted in a water jacket near an intake port of a cylinder head and is covered with an intake manifold. It is therefore unnecessary to provide a case and a lid for mounting the thermostat.

18 Claims, 14 Drawing Sheets

WATER-COOLED FOUR CYCLE ENGINE

BACKGROUND OF THE INVENTION

1. Field of the Invention

The present invention relates to a water-cooled four cycle engine, and particularly to a water-cooled four cycle engine suitable for a hybrid type power unit including an electric motor in addition to a gasoline engine. The present invention also relates to a thermostat mounting structure for a water cooled engine, and particularly to a thermostat mounting structure suitable for a motorcycle on which a small-sized water-cooled engine is mounted.

2. Description of Background Art

Vehicles having a gasoline engine as a drive source are mainly available at present; however, vehicles having an electric motor as a drive source are also required at locations where exhaust gas must be avoided. An electric motor-driven vehicle, however, has increased body weight and shortened running distance compared to a gasoline engine driven vehicle. Therefore, it has been increasingly necessary to develop a hybrid type vehicle including an electric motor in addition to an engine.

For example, Japanese Patent Laid-open No. Hei 8-175477 discloses a hybrid type motorcycle entitled "Device for Switching Engine Power to/from Motor Power in Motorcycle or the Like".

In the above-mentioned document, an engine 10 is a simple air-cooled two cycle engine.

In a hybrid type power unit, however, it is desired to mount a water-cooled four cycle engine in consideration of fuel consumption, emission and the like. A water-cooled four cycle engine requires a water pump for water cooling, and a cam shaft drive mechanism for driving a valve mechanism. A water-cooled engine also requires a cooling water line including a radiator, thermostat and the like.

FIG. 14 is a view showing one example of a related art cooling water line for a motorcycle. Referring to FIG. 14, after having been used for cooling a cylinder block 201 and a cylinder head 202, hot water flows to a radiator 204 through a thermostat 203 as shown by a black arrow, being forcibly cooled at the radiator 204. The water thus cooled flows to an engine 200 as shown by a white arrow.

In FIG. 14, 207 is a water pump; 208 is a siphon tube of the radiator 204; 209 is a radiator cap; 210 is a reserve tank; and 211 is an overflow tube of the reserve tank 210.

Since the temperature of cooling water is low immediately after the engine 200 starts to be operated, the thermostat 203 is closed and the cooling water is circulated to the engine 200 not by way of the radiator 204 to promote temperature rising of the engine 200.

In the above example, since the thermostat 203 is required to be contained in a case 205 and covered with a lid 206, the number of parts associated with the thermostat 203 is increased. In a motorcycle having a limitation in its part mounting space, it is desired to reduce the number of parts.

Furthermore, a water pump, a cam shaft and the like are driven by auxiliary power supplied from a crank shaft, and therefore, the weight of the engine becomes large. In particular, in a hybrid type power unit including an electric motor in addition to an engine, the size and weight of the unit increase.

SUMMARY AND OBJECTS OF THE PRESENT INVENTION

An object of the present invention is to provide a compact water-cooled four cycle engine suitable for a hybrid type power unit.

To achieve the above object, according to the present invention, there is provided a water-cooled four cycle engine including a cam shaft drive mechanism in which a winding means is wound around a cam shaft drive rotator mounted on a crank shaft. A cam shaft rotator is rotated by the winding means. Furthermore, a water pump includes a pump chamber and a pump housing. The pump housing includes a housing base, movably mounted on a cylinder block or a cylinder head, for rotatably supporting a pump rotor of the water pump. A housing cover covers the housing base. Furthermore, the pump rotor having an impeller is disposed in the pump chamber and a pump pulley linked to the pump rotor is rotated by the winding means.

With this configuration, since the pump pulley is movable with respect to the cylinder block or cylinder head, it can serve as a tensioner of the winding means for driving the cam shaft. Accordingly, it is possible to reduce the number of parts and realize a compact water-cooled four cycle engine suitable for a hybrid type power unit.

According to another aspect of the present invention, there is provided a thermostat mounting structure for a water-cooled engine, wherein a thermostat is mounted to a cylinder head of a water-cooled engine and is covered with an intake manifold.

With this configuration, since the thermostat is directly mounted on the cylinder head, it is unnecessary to provide the related art case, and since the thermostat is covered with the intake manifold, it is unnecessary to provide the related art lid.

Accordingly, it is possible to reduce the number of parts for mounting the thermostat.

According to the this aspect of the present invention, a water channel is formed in the intake manifold and hot water is led from a portion near the thermostat to a hot water riser for heating intake air through the water channel.

With this configuration, since intake air is heated with the hot water riser, it is possible to enhance the engine efficiency.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
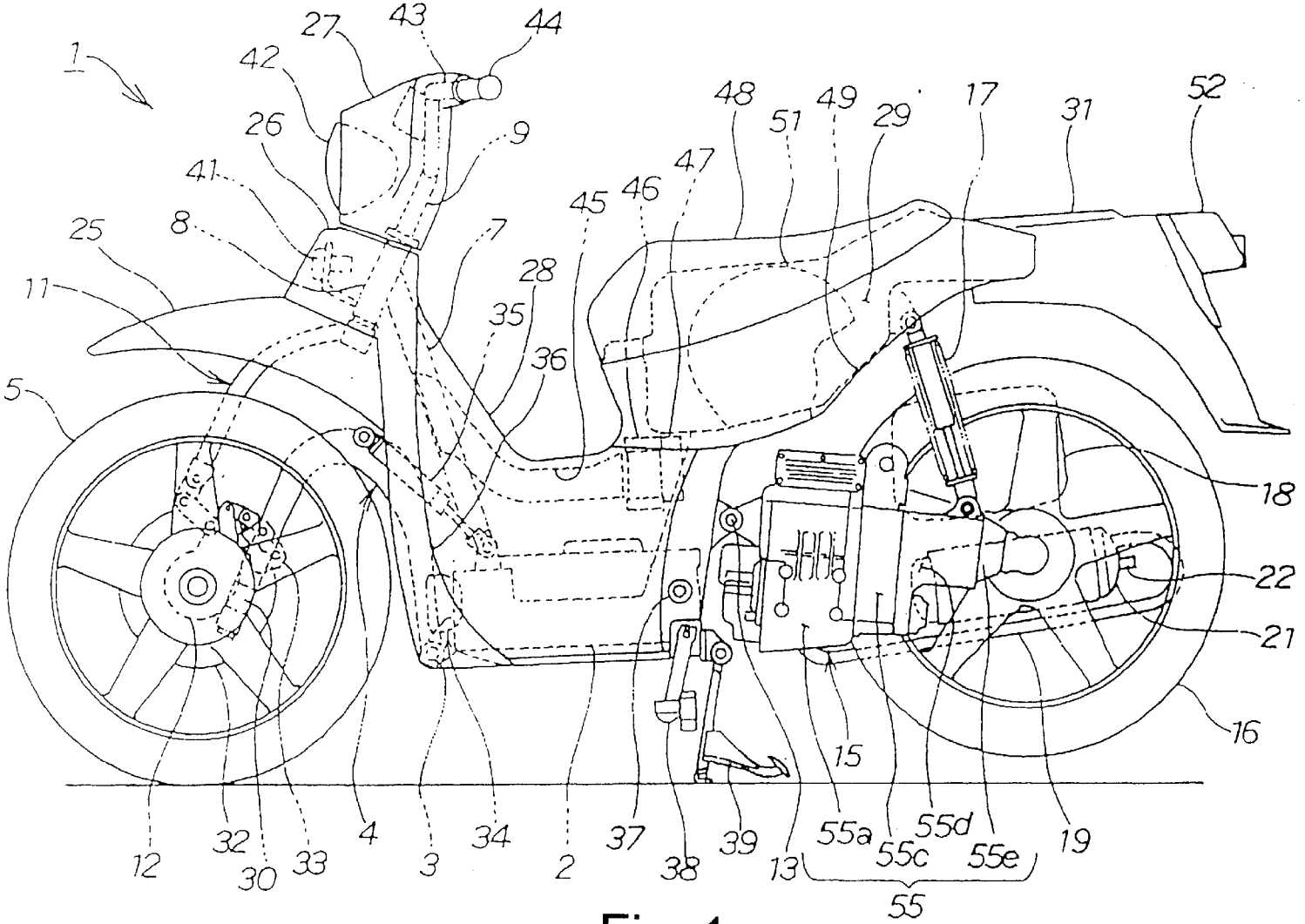
FIG. 1 is a side view of a motorcycle according to the present invention.

Hereinafter, an embodiment of the present invention will be described with reference to the accompanying drawings. It is to be noted that the drawings should be seen in the direction of reference numerals.

FIG. 1 is a side view of a motorcycle according to the present invention.

Referring to FIG. 1, a motorcycle 1 has at its lower central portion a box-like main frame 2 serving as a battery containing box. Inverse U-shaped front swing arms 4 extend from a lower front portion of the main frame 2 through a front pivot 3. A front wheel 5 is rotatably mounted on the front swing arms 4. A head pipe post 7 extends obliquely upward from an upper front portion of the main frame 2 and a head pipe 8 is fixed at a leading end of the head pipe post 7. A handle post 9 is rotatably mounted in the head pipe 8, and a steering arm 11 is mounted on a lower end of the handle post 9. A leading end (lower end) of the steering arm 11 is connected to a knuckle 12 mounted on the front wheel 5. A power unit 15 is swingably mounted on an upper rear portion of the main frame 2 through a rear pivot 13 functioning as a swing shaft. A rear wheel 16 is mounted on the power unit 15. A rear cushion of shock absorber 17 is disposed in front of the rear wheel 16. An air cleaner 18, an exhaust pipe 19, a muffler 21, and a tail lamp 22 are disposed behind the rear wheel 16. A vehicular body is surrounded by a front fender 25, a front cover 26, a front handle cover 27, a center cowl 28, a rear cowl 29 and a rear fender 31 which are disposed in this order from the front side to the rear side of the vehicular body.

In FIG. 1, reference numeral 30 indicates a stem; 32 is a front brake disk; 33 is a caliper; 34 is a resin spring; 35 is a front damper; 36 is a leg shield; 37 is a passenger's step; 38 is a side stand; and 39 is a main stand. On an upper side of FIG. 1, reference numeral 41 indicates a horn; 42 is a front lamp; 43 is a handlebar; 44 is a grip; 45 is a baffle duct; 46 is a radiator; 47 is a fan; 48 is a sheet; 49 is a helmet box; 51 is a helmet; 52 is a tail lamp; and 55 is a power unit case.

The power unit case 55 is composed of right and left crank cases 55*b* and 55*a* (the right crank case 55*b* on the back side of the figure is not shown), a transmission case 55*c*, an electric motor case 55*d*, and a reduction gear case 55*e*.

Figure 2:
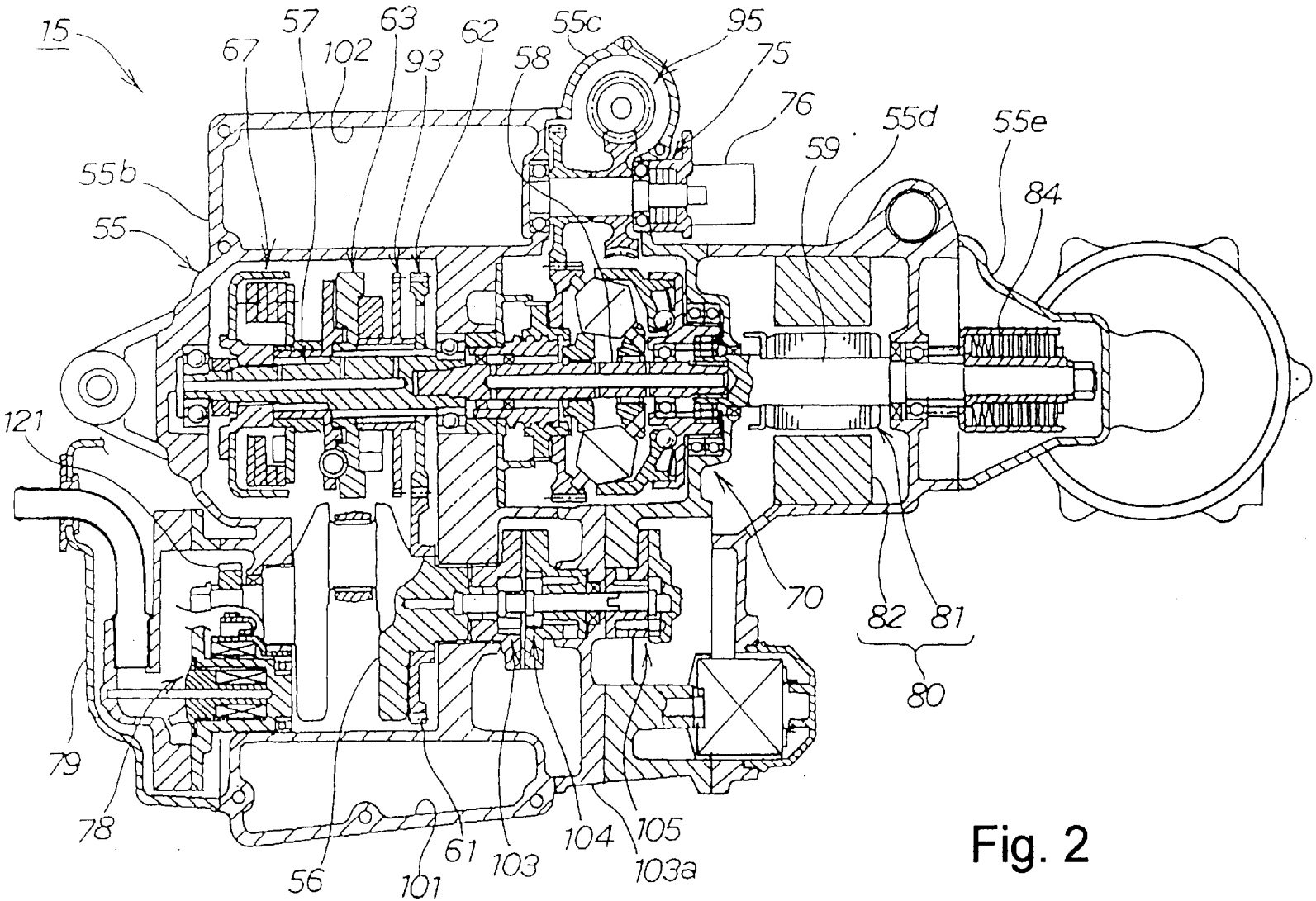
FIG. 2 is a sectional side view of a power unit according to the present invention.

FIG. 2 is a sectional side view of the power unit according to the present invention.

As will be fully described with reference to FIG. 8, the power unit 15 includes a four-cycle engine in which an intake cam shaft and an exhaust cam shaft are provided in a cylinder head. The power unit 15 has a crank shaft 56 disposed in a lower portion of the power unit case 55; a clutch shaft 57 disposed in parallel to and higher than the crank shaft 56; and a transmission shaft 58 and an electric motor shaft 59 disposed in such a manner as to extend from one end of the clutch shaft 57 in the longitudinal direction (fore and aft) of the vehicular body. More specifically, the clutch shaft 57, transmission shaft 58, and electric motor shaft 59 are disposed in series and also in parallel to and higher than the crank shaft 56.

Since the clutch shaft 57, transmission shaft 58, and electric motor shaft 59 are disposed in series in the longitudinal direction of the vehicular body, the direction of a force applied to the power unit case 55 is simplified. This facilitates the design of the power unit case 55. Therefore, the power unit case 55 can be designed such that the rigidity is high in the direction where the force is applied and the rigidity is low in the direction where the force is not applied. Consequently, the power unit case 55 can be reduced in weight and also be made compact as a whole in proportion to simplification of the force applied to the power unit case 55.

In FIG. 2, reference numeral 75 indicates an epicycle reduction gear; 76 is a potentiometer for detecting a rotational angle of a transmission control motor 95 to be described later; 121 is a cam shaft drive pulley; 78 is a water pump driven by the pulley 121; 79 is a belt cover; and 103*a* is an oil pump case disposed at a lower central portion of the figure.

A primary drive gear 61, a primary driven gear 62, a centrifugal clutch 67, and a transmission 70, (which is further provided with an electric motor shaft 59 when the electric motor 80 is operated for assisting the engine power), constitutes a power transmission system for transmitting power from the engine. The electric motor shaft 59, when the electric motor 80 is operated, constitutes a power transmission system for transmitting power from the electric motor.

The details of components associated with the clutch shaft 57, transmission shaft 58, and electric motor shaft 59 will be fully described with reference to FIG. 3.

Figure 3:
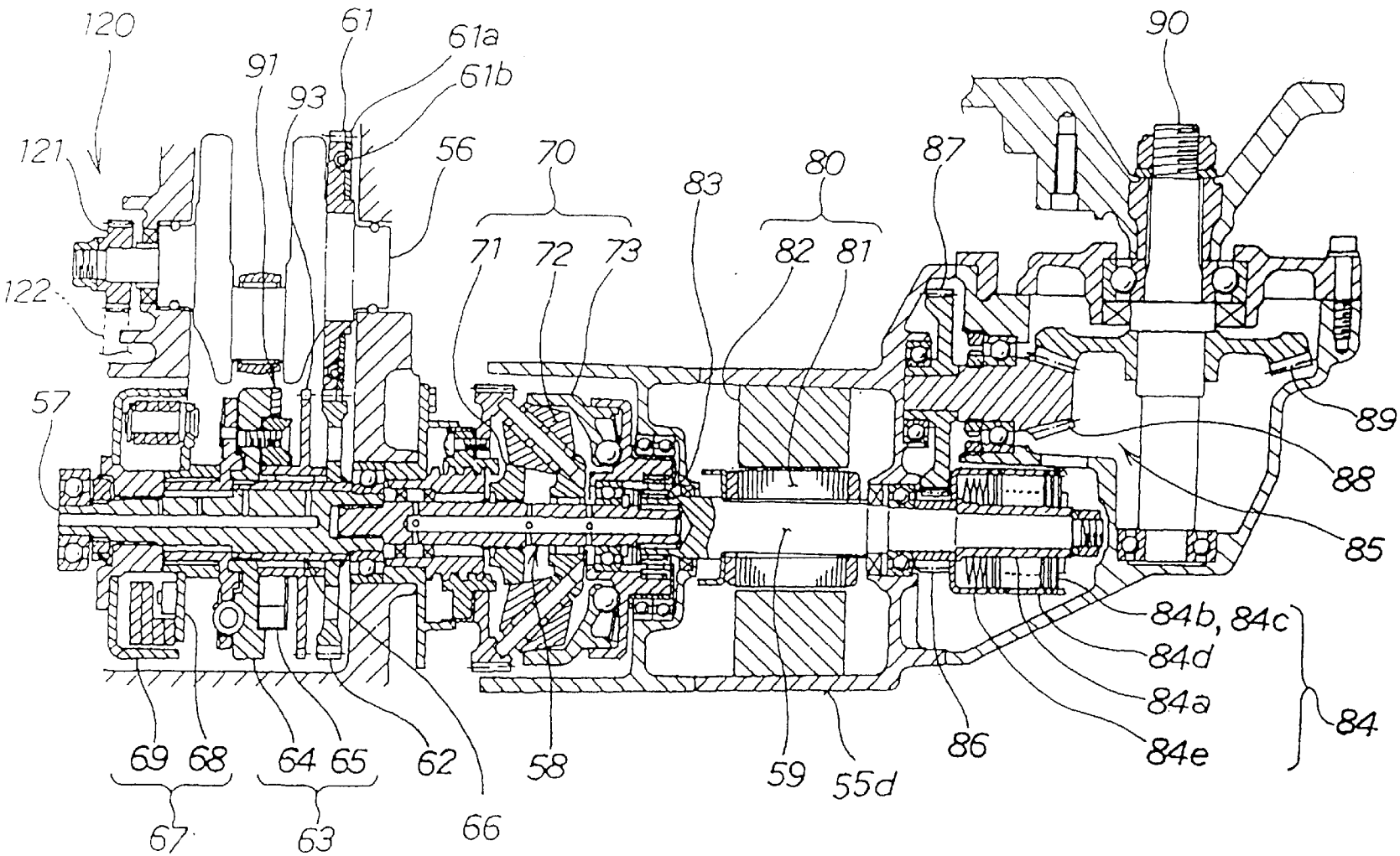
FIG. 3 is a sectional plan view of the power unit according to the present invention.

FIG. 3 is a sectional plan view of the power unit according to the present invention. The details of the components associated with the clutch shaft, transmission shaft, and electric motor shaft, and the drive force transmission configuration will be described with reference to this figure.

The primary driven gear 62 rotatably mounted on the clutch shaft 57 is driven by the primary drive gear 61 mounted on the crank shaft 56. The primary driven gear 62 drives an outer clutch 64 of a one-way clutch 63 for a starter and an inner clutch 68 of the centrifugal clutch 67 independently from the clutch shaft 57. For this purpose, the primary driven gear 62 is connectable to both the outer clutch 64 of the one-way clutch 63 and the inner clutch 68 of the centrifugal clutch 67 by means of a cylindrical member 66. As the centrifugal inner clutch 68 is rotated at a rotational speed of a specific value or more, a centrifugal outer clutch 69 is rotated together with the centrifugal inner clutch 68, resulting in the clutch shaft 57 being rotated.

The above primary drive gear 61 includes a phase difference adjusting sub-gear 61*a* and a spring 61*b* for preventing occurrence of gear rattle.

The transmission 70, which is of a cone type with its function fully described with reference to another figure, transmits power in the order of the transmission shaft 58, from an inner disk 71, to a cone 72, and then to an outer cup 73. The rotation of the outer cup 73 is then transmitted to the electric motor shaft 59 through a one-way clutch 83.

The electric motor 80 is of a coreless type, in which a permanent magnet type rotor 81 is mounted on the electric motor shaft 59 and a stator coil 82 is mounted on an electric motor case 55*d*.

When the centrifugal clutch 67 is turned on, a drive force is transmitted in the order of the clutch shaft 57, transmission shaft 58, transmission 70, and electric motor shaft 59, and acts to drive an axle 90 through a multi-disk type torque limiter 84 and a reduction gear mechanism 85 (which is composed of a small gear 86, a large gear 87, a small gear 88, and a large gear 89).

The multi-disk type torque limiter 84 includes an inner limiter 84*a* rotated together with the electric motor shaft 59, disks 84*b* and 84*c* (the disk 84*b* is mounted on the inner limiter 84*a* and the disk 84*c* is mounted on the following outer limiter 84*d*), an outer limiter 84*d*, and a spring 84*e*. The small gear 86 is integrated with the outer limiter 84*d*.

Power is transmitted in the order of the limiter inner 84, from the disk 84*b*, to the disk 84*c*, to the outer limiter 84*d*, and then to the small gear 86. If excess torque over a predetermined value is applied, there occurs a slip between the disks 84*b* and 84*c* for protecting the components of the multi-disk torque limiter 84. The predetermined torque can be set by the spring 84*e*.

The one-way outer clutch 64 for a starter acts as a flywheel and has a balance weight 91 for taking an engine balance. The one-way outer clutch 64 constitutes the one-way clutch 63 for transmitting rotation of a starter in combination with the one-way inner clutch 65.

When a starter driven gear 93 is rotated by a starter (not shown), the centrifugal inner clutch 68 is rotated through the one-way inner clutch 65 and the one-way outer clutch 64, to start operation of the engine. When the one-way outer clutch 64 is rotated at a higher speed, it is separated from the inner clutch 65 on the low speed side.

In FIG. 3, the cam shaft drive pulley 121 for driving a cam shaft or the like is provided on the other end (front end) of the crank shaft 56. A belt 122 is driven by the pulley 121. The details of the pulley 121 and the belt 122 will be fully described later.

Figure 4:
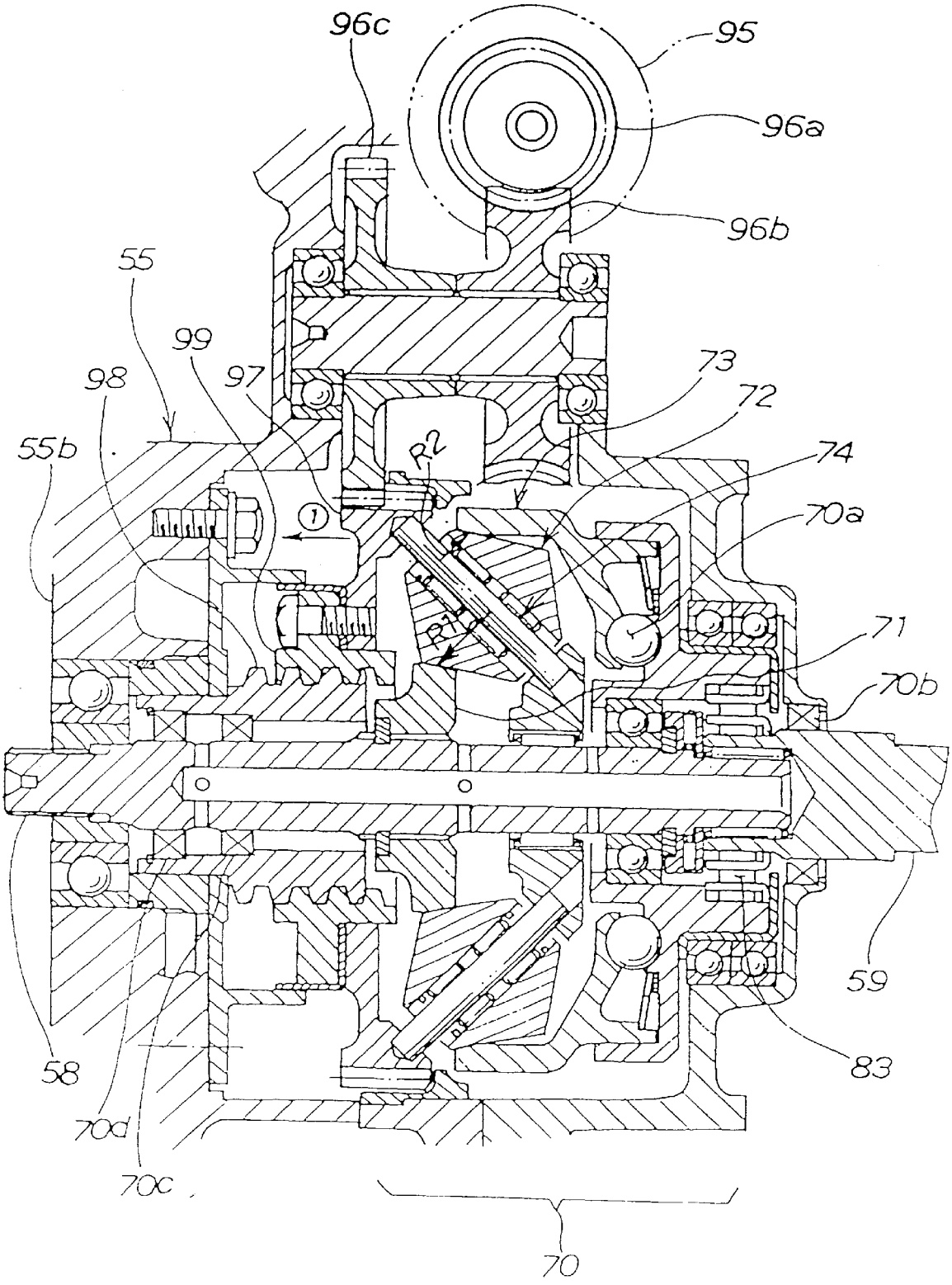
FIG. 4 is a view showing a configuration and a function of a cone type continuously variable transmission according to the present invention.
Figure 5:
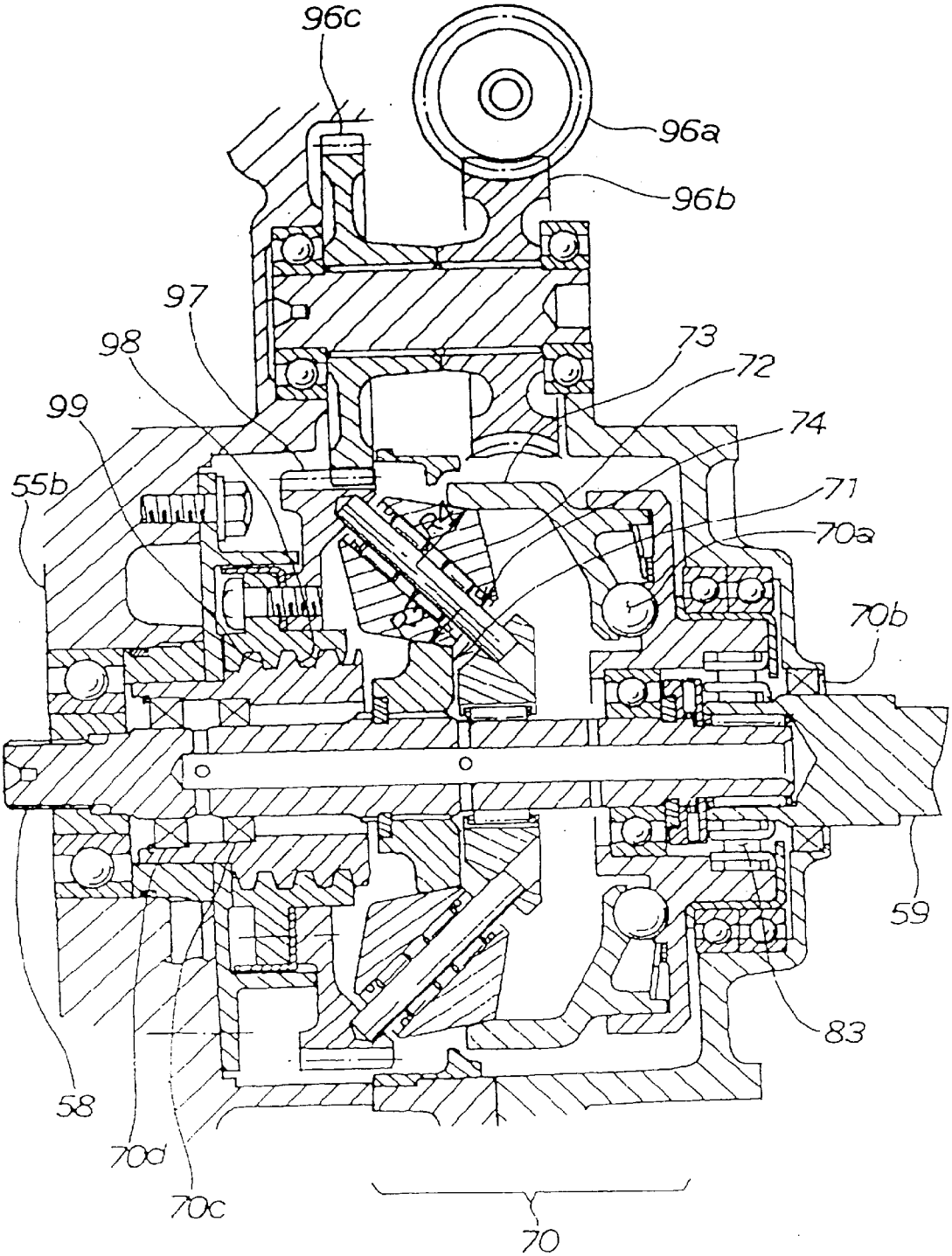
FIG. 5 is a view showing a configuration and a function of the cone type continuously variable transmission according to the present invention.

FIGS. 4 and 5 are views illustrating a configuration and a function of the cone type continuously variable transmission according to the present invention.

In the state of the cone 72 shown in FIG. 4, a relationship of R1>R2 is given. R1 is a distance from the center of a cone supporting shaft 74 to the inner disk 71, that is, a rotational radius of the inner disk 71. R2 is a distance from the center of the cone supporting shaft 74 to the outer cup 73, that is, a rotational radius of the outer cup 73.

The cone 72 is rotated at a low speed because a large diameter portion (radius: R1) of the cone 72 is rotated by the inner disk 71, and the outer cup 73 is rotated at a low speed because the outer cup 73 is rotated by the small diameter portion (radius: R2) of the cone 72.

When rotation of the outer cup 73 is higher than that of the electric motor shaft 59, power is transmitted from the outer cup 73 to the electric motor shaft 59 through the one-way clutch 83.

Reference numeral 70*a* indicates a cam ball for pushing the outer cup 73 leftward along with rotation of the outer cup 73. Such a pushing action allows a contact pressure to be applied between the outer cup 73 and the cone 72.

Reference numerals 70*b*, 70*c* and 70*d* indicate oil seals. The oil seals 70*b* and 70*c* form a closed space for accumulating transmission oil in the transmission 70, and the oil seal 70*d* cuts off oil on the crank case 55*b* side (on the left side of the figure). Accordingly, there is no fear that oil in the crank case will mix with transmission oil.

In the state of the cone 72 shown in FIG. 5, a relationship of R3<R4 is given. R3 is a distance from the center of the cone supporting shaft 74 to the inner disk 71, that is, a rotational radius of the inner disk 71. R4 is a distance from the cone supporting shaft 74 to the outer cup 73, that is, a rotational radius of the outer cup 73.

The cone 72 is rotated at a high speed because the small diameter portion (radius: R3) of the cone 72 is rotated by the inner disk 71, and the outer cup 73 is rotated at a high speed because the outer cup 73 is rotated by the large diameter portion (radius: R4) of the cone 72.

By moving the cone 72 as shown in FIGS. 4 and 5, the transmission 70 transmits rotation at a reduced speed, a uniform speed, or an increased speed.

For this purpose, as shown in FIG. 4, a control gear 97 is shifted by the transmission control motor 95 through gears 96*a*, 96*b* and 96*c*. The control gear 97 has a trapezoid female thread portion 99 formed on its boss portion. The trapezoid female thread portion 99 is meshed with a trapezoid male thread portion 98 fixed on the case 55 side. The control gear 97 is shifted leftward in the figure by spiral motion of the trapezoid female thread portion 99. The leftward shift of the control gear 97 moves the cone 72 leftward in the figure together with the cone supporting shaft 74 into the state shown in FIG. 5.

It is important that both the trapezoid male thread portion 98 and the trapezoid female thread portion 99 be provided on the inner disk 71 side and not on the outer cup 73 side. The cone 72 is pushed leftward in the figure by reaction of the outer cup 73. As a result, the control gear 97 is applied with a force in the direction shown by an arrow "1", that is, in the direction from the low speed side to the high speed side. With the configuration in this embodiment, the cone 72 can be shifted to the high speed side with a small torque. This is effective to lower the capacity of the transmission control motor 95.

Figure 6:
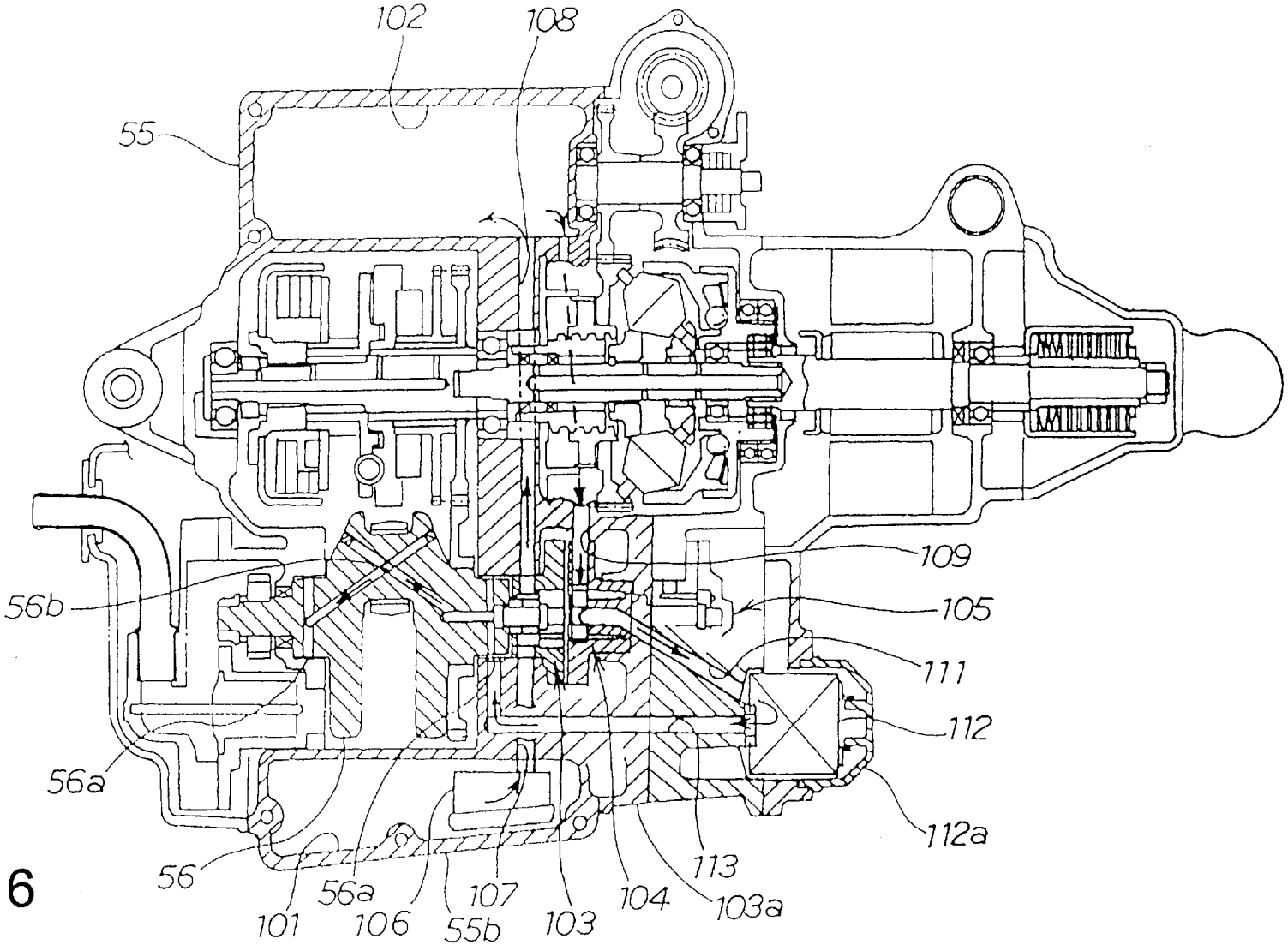
FIG. 6 is a view illustrating an engine lubricating system according to the present invention.

A lubricating system will be described below with reference to FIG. 6. FIG. 6 is a view illustrating an engine lubricating system according to the present invention, in which the flow of oil is indicated by arrows.

The power unit case 55 has a lower oil tank 101 disposed at its lower portion, and an upper oil tank 102 disposed at its upper portion. A first oil pump 103, a second oil pump 104, and a third oil pump 105 are coaxially disposed on one end side (right end side) of the crank shaft 56. First, oil in the lower oil tank 101 is pumped by the first oil pump 103 through a strainer 106 and a first oil passage 107, and is supplied to the upper oil tank 102 through a second oil passage 108.

The oil in the upper oil tank 102 flows to the second oil pump 104 through a third oil passage 109 and is pressurized by the second oil pump 104. The oil thus pressurized lubricates main journal portions 56*a*, a connecting rod large end portion 56*b*, and others (particularly, a valve chamber not shown) through a fourth oil passage 111, a filter 112, and a fifth oil passage 113. The oil then returns to the lower oil tank 101. In this figure, reference numeral 112*a* indicates a filter cover.

Figure 7:
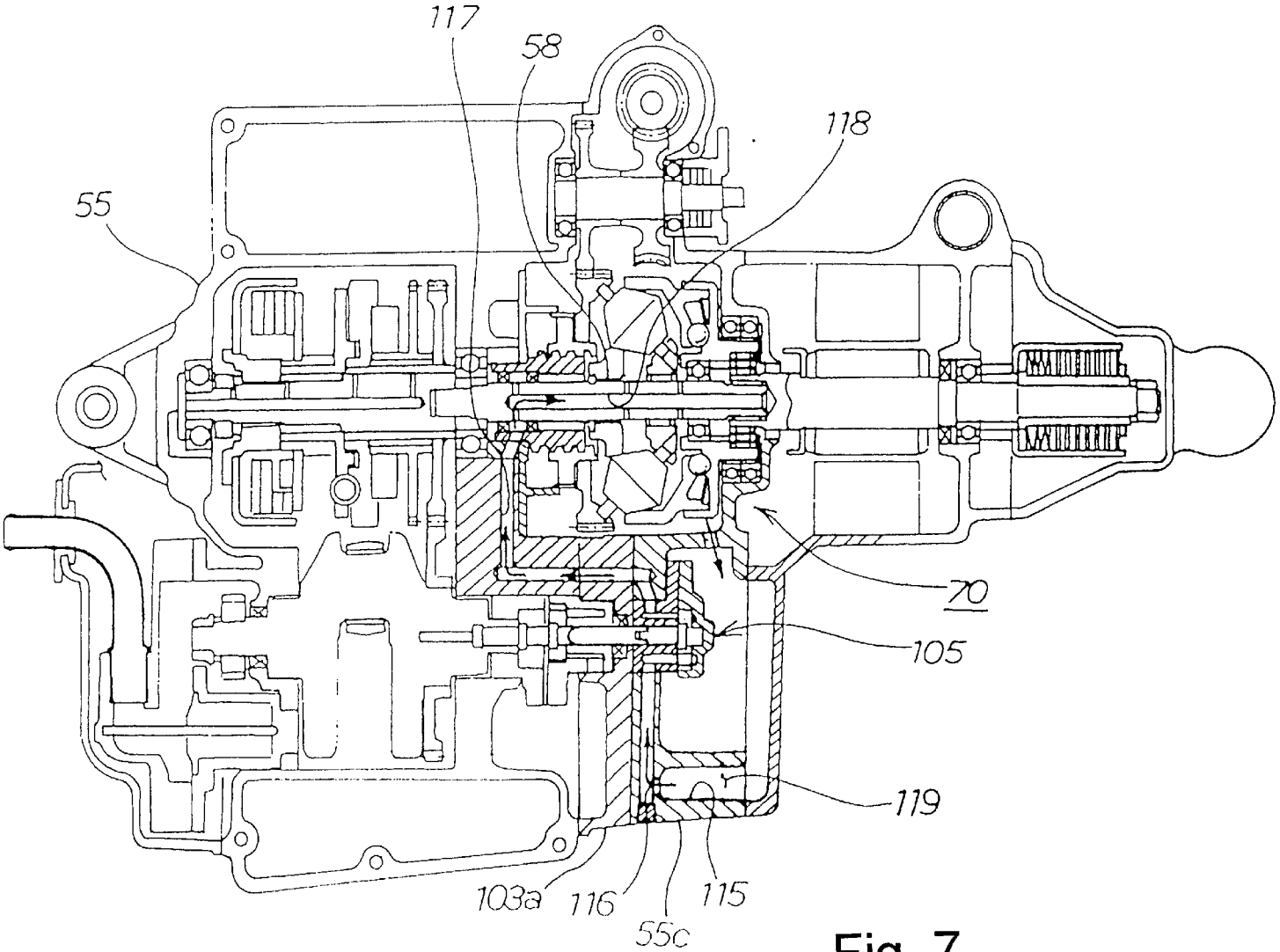
FIG. 7 is a view illustrating a transmission lubricating system according to the present invention.

FIG. 7 is a view illustrating a transmission lubricating system according to the present invention. Referring to FIG. 7, transmission oil is pumped from a transmission oil tank 115 additionally provided on a lower portion of the power unit case 55 by the third oil pump 105 through a sixth oil passage 116. The oil is fed to the transmission shaft 58 through a seventh oil passage 117, and is supplied to the transmission 70 through an oil passage 118 in the transmission shaft 58. The oil is then returned to the transmission oil tank 115 in the direction shown by an arrow in the figure, and is pumped by the third oil pump 105 through a strainer 119.

Figure 8:
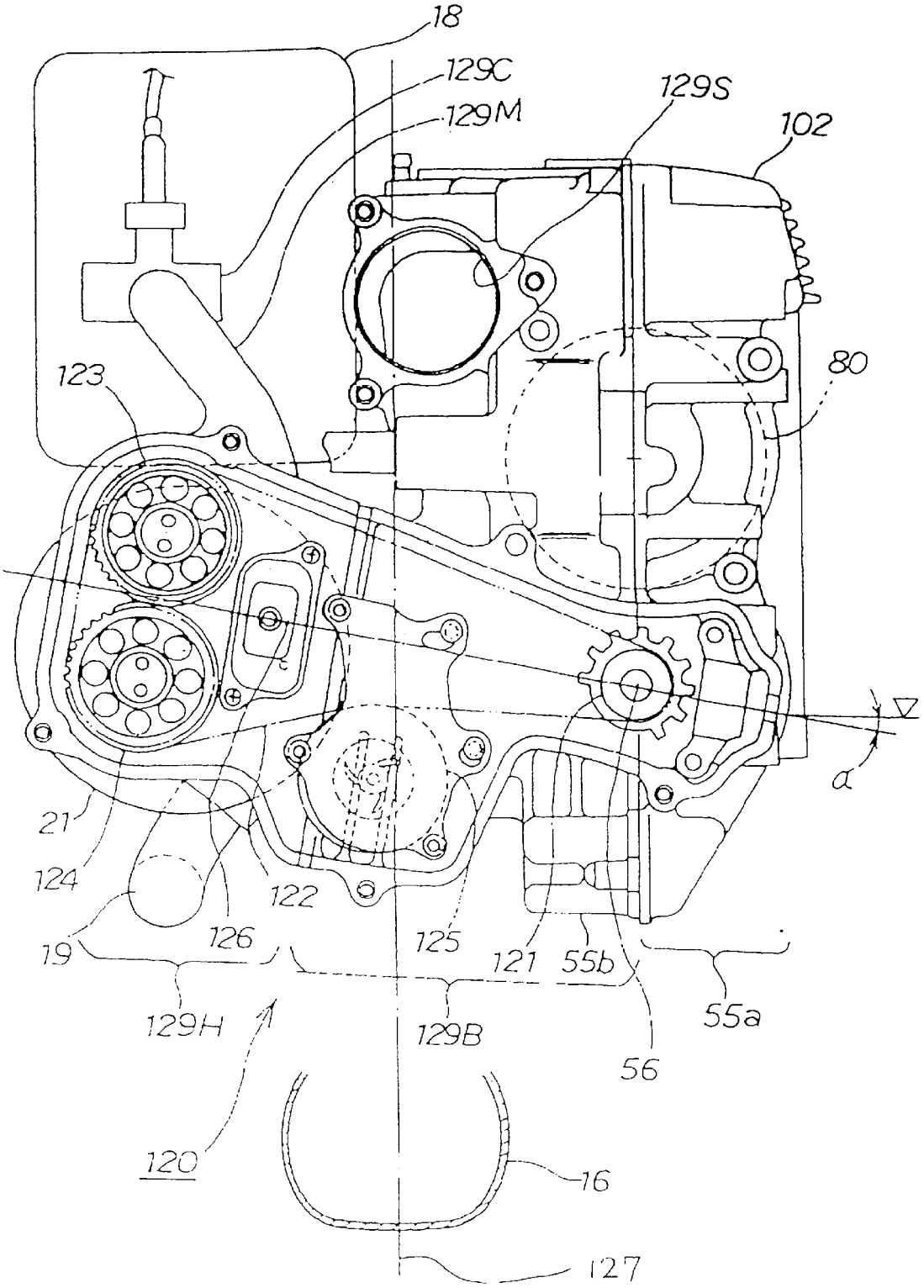
FIG. 8 is a front view of the power unit, showing a cam shaft drive mechanism as a valve system drive mechanism according to the present invention.

FIG. 8 is a front view of the power unit, showing a cam shaft drive mechanism as a valve drive mechanism according to the present invention.

Referring to FIG. 8, the left crank case 55*a* is mounted on the right side of a cylinder block 129B integrated with the right crank case 55*b*. The electric motor 80 is disposed higher than the crank shaft 56. A cylinder head 129H is mounted on the left side of the cylinder block 129B. The muffler 21 is mounted at the leading end of the exhaust pipe 19 extending from the cylinder head 129H. An intake manifold 129M extending from the air cleaner 18 on the upper left side (and on the back side of the figure) is connected to the cylinder head 129H through a carburetor 129C. Reference numeral 129S indicates a starter motor mounting hole.

In FIG. 8, since a belt cover 79 is removed, there can be seen, from the front side of the power unit 15, a cam shaft drive mechanism 120 as the valve drive mechanism composed of a cam shaft drive pulley 121, a belt 122, an intake side cam shaft pulley 123, an exhaust side cam shaft pulley 124, and a tensioner 125.

The belt 122 may be replaced with a chain, and the pulleys 121, 123 and 124 may be replaced with sprockets. Therefore, the belt 122 may be referred to as a "winding means" represented by a timing belt, V-belt or roller chain. The cam shaft drive pulley 121 may be referred to as a "cam shaft drive rotator" rotated by the winding means. Each of the cam shaft pulleys 123 and 124 may be referred to as a "cam shaft rotator" rotated by the winding means. The means may be selected from any part other than the above chain or sprocket insofar as it exhibits the function described above.

As is apparent from FIG. 8, since the cylinder is disposed in the width direction of the vehicular body with its cylinder axis 126 substantially in the horizontal direction (for example, a tilt angle with respect to the ground is set at +10°), the center of gravity of the vehicle is lowered and also the cylinder length can be set within the vehicular width. This increases the degree of design of the vehicle.

In FIG. 8, which is seen in the direction from the front wheel side to the rear wheel side, both the crank shaft 56 and the clutch shaft 57 are disposed on the right side from a body center 127, and the cylinder head 129H is disposed on the left side from the body center 127. Behind the clutch shaft 57 in the figure are disposed the shafts of "the power transmission system" such as the transmission shaft 58 and the electric motor shaft 59, as described with reference to FIGS. 2 and 3.

Figure 9:
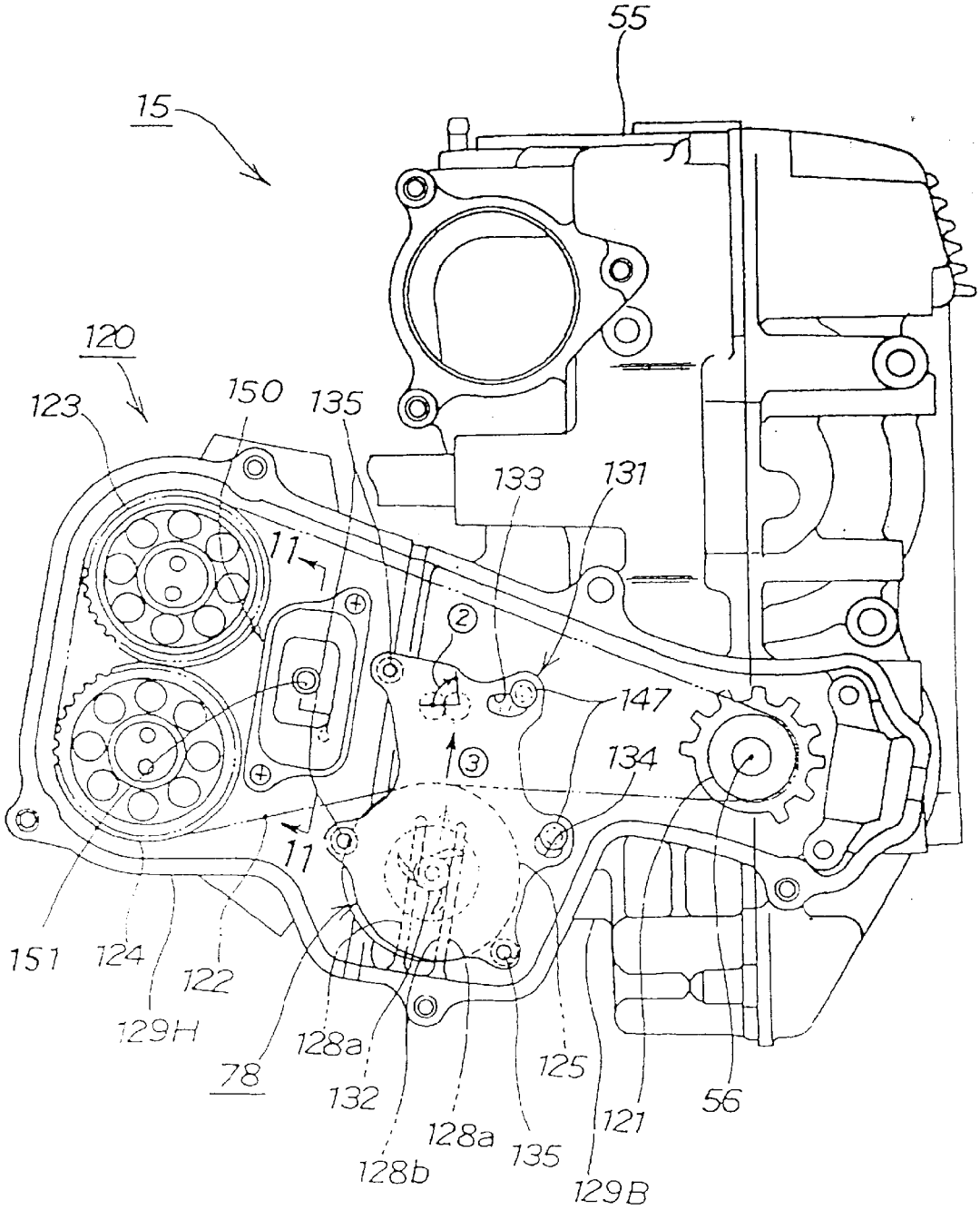
FIG. 9 is a view showing an arrangement of an AI reed valve and a water pump according to the present invention.

FIG. 9 is a view showing an arrangement of an AI reed valve and a water pump according to the present invention.

Reference numeral 150 indicates an AI (Air Injection) reed valve, which is a check valve provided in a system for promoting purification of exhaust gas by blowing air into an exhaust port in a suitable amount. The structure of the AI reed valve 150 will be described with reference to FIG. 11. Since the AI reed valve 150 is provided on the front side of the cylinder head 129H, the maintenance of the AI reed valve 150 can be easily performed by removal of the belt cover in the same manner as for inspection of the cam shaft drive mechanism 120. Furthermore, with the above arrangement, the AI reed valve 150 can be protected by the belt cover.

The common pulley 125 serves as both the above-described tensioner for adjusting tension of the belt 122 and a pump pulley. The common pulley 125 is rotatably mounted on a pump housing 131 of the water pump 78 as will be fully described later.

The pump housing 131 contains a pump rotor 132 and two adjustment slots 133 and 134. Reference numerals 135 indicate a plurality of small screws used for assembly of the pump housing 131.

Two projecting ribs 128*a* project from the cylinder block 129B in parallel to each other, between which a guide groove 128*b* is provided.

Figure 10:
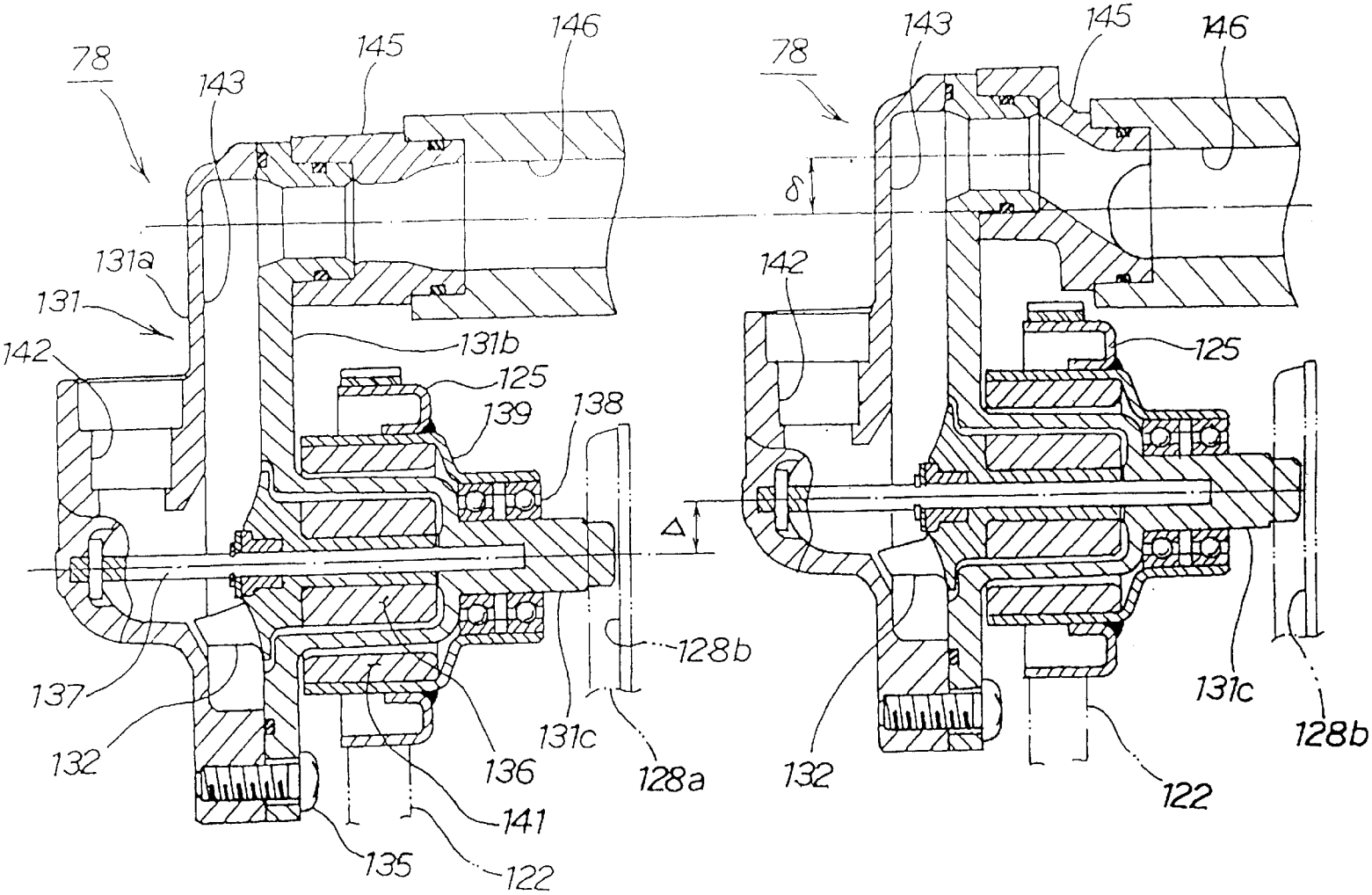
FIGS. 10(*a*) and 10(*b*) are sectional views showing the water pump of the present invention and also showing mounting of a common pulley.

FIGS. 10(*a*) and 10(*b*) are sectional views showing the water pump according to the present invention and also showing mounting of the common pulley.

Referring to FIG. 10(*a*), the water pump 78 includes a pump rotor 132; an inner magnet 136 mounted on the pump rotor 132; a rotor supporting shaft 137 for rotatably supporting the pump rotor 132; a housing cover 131*a* for supporting one end of the rotor supporting shaft 137; a housing base 131*b* for supporting the other end of the rotor supporting shaft 137; a shaft portion 131*c* formed on the housing base 131*b;* a cup 139 mounted on the shaft portion 131*c* through bearings 138; an outer magnet 141 mounted on an inner peripheral surface of the cup 139; and the common pulley 125 mounted on an outer peripheral surface of the cup 139. The pump housing 131 is composed of the housing cover 131*a,* housing base 131*b,* and shaft portion 131*c*.

When the common pulley 125, cup 139 and outer magnet 141 are rotated by movement of the belt 122, lines of magnetic force of the outer magnet 141 reach the inner magnet 136 through the housing base 131*b,* to impart a rotational force to the inner magnet 136, whereby the pump rotor 132 starts to rotate.

Accordingly, the water pump 78 pressurizes water pumped from a suction passage 142 by the pump rotor 132, and supplies the water into a water inlet 146 of the cylinder block through a discharge passage 143 and an eccentric tube fitting 145. The eccentric tube fitting 145 is a fitting in which an inlet is eccentric a distance with respect to an outlet as shown in FIG. 10(*b*).

By rotating the eccentric tube fitting 145 by 90° to the state shown in FIG. 10(*a*), the water pump 78 can be moved a distance A in parallel to the water inlet 146 of the cylinder block as shown in FIG. 10(*b*).

Referring to FIG. 9 again, tension of the belt 122 is increased by loosening bolts 147, turning the eccentric tube fitting 145 in the direction shown by an arrow "2", and moving the common pulley 125 in the direction shown by an arrow "3". After the tension of the belt 122 is thus adjusted, the bolts 147 are fastened.

The water pump 78, which is supported by shaft portion 131*c* (see FIG. 10(*b*)) fitted in the guide groove 128*b* and by the two bolts 147, is not moved except for the step of adjusting the tension of the belt 122.

Figure 11:
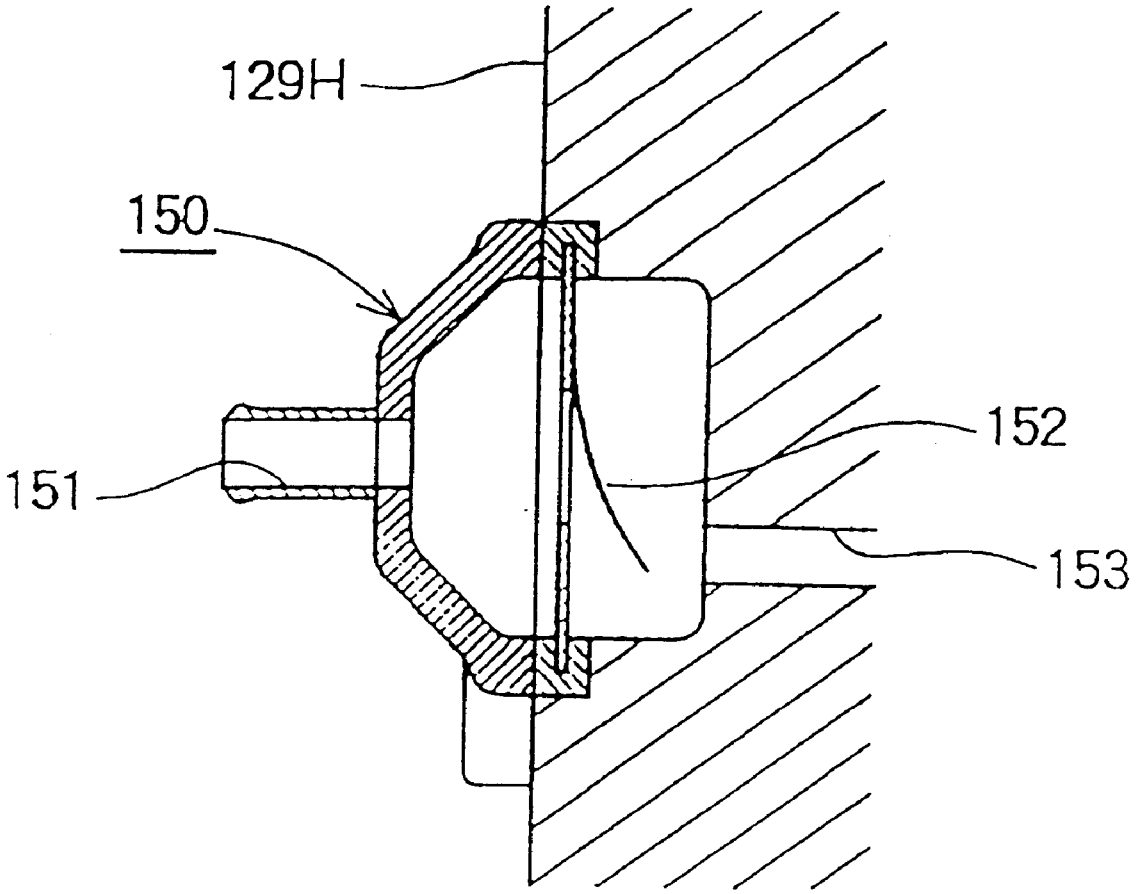
FIG. 11 is a sectional view taken on line 11—11 of FIG. 9.

FIG. 11 is a sectional view taken on line 11—11 of FIG. 9. Referring to FIG. 11, the AI reed valve 150 supplies air, which is blown from the air inlet 151, into the exhaust port through an AI port 153 opened in a reed valve 152 and the cylinder head 129H. When pressure on the AI port 153 side is increased, the reed valve 152 is closed, so that there is no air or exhaust gas flows backward into the air inlet 151.

Although the mechanism for driving the pump rotor 132 of the water pump 78 by the common pulley 125 is realized using the magnet in this embodiment, it may be realized by letting one end of the rotor supporting shaft 137 project from the housing cover 131*a* and mounting the common pulley 125 on the projecting end of the rotor supporting shaft 137.

Furthermore, in this embodiment, the water pump 78 is mounted to the cylinder block 129B; however, it may be mounted to the cylinder head 129H.

Since the power unit 15 in this embodiment includes the electric motor 80 in addition to the engine, and the crank shaft 56 and the electric motor shaft 59 are disposed in the longitudinal direction (fore and aft) of the vehicular body, it is possible to simplify the layout of the components.

It is to be noted that the present invention can be applied to a motorcycle using a gasoline engine as a drive source.

Figure 12:
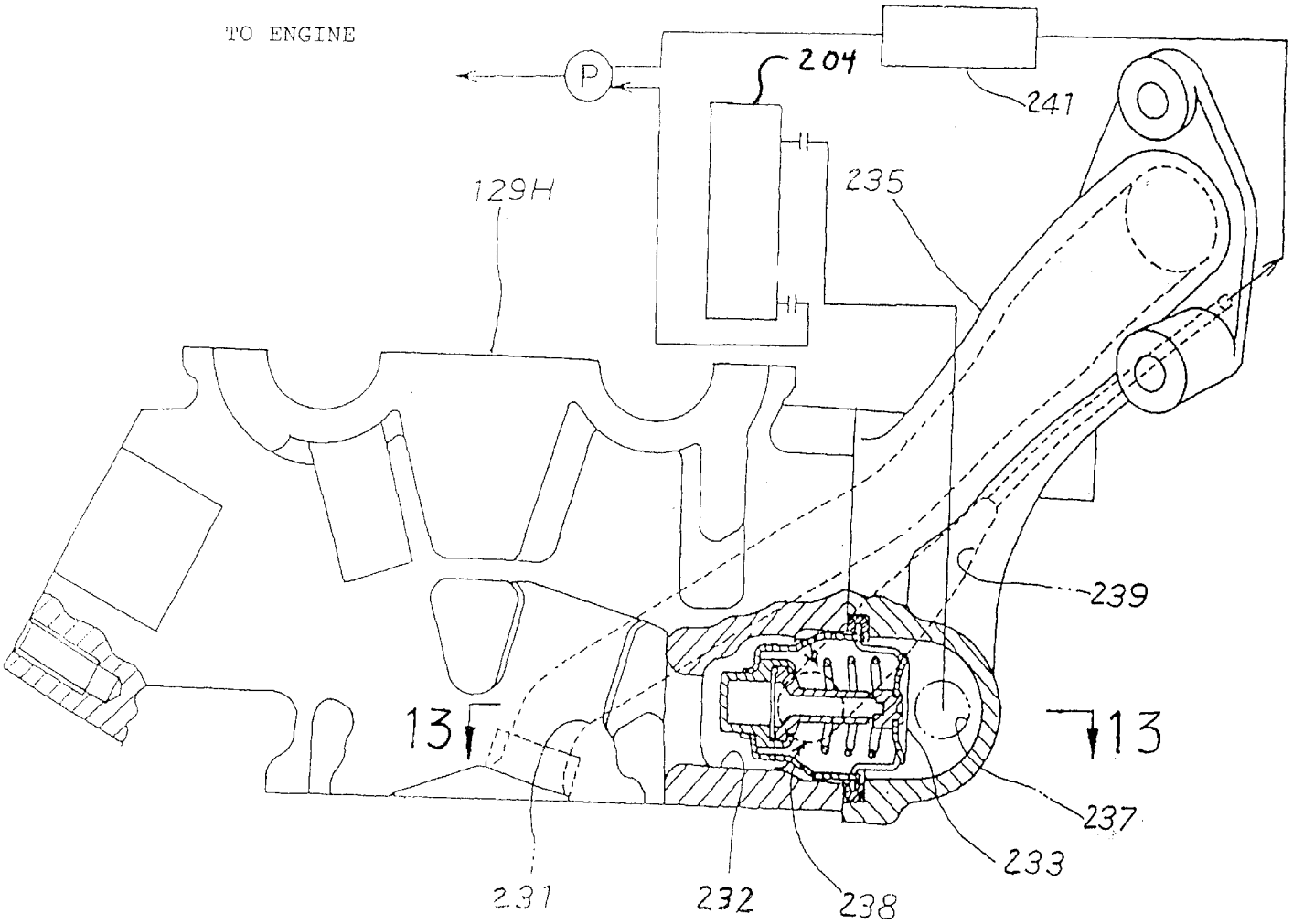
FIG. 12 is a view showing a structure for mounting a thermostat according to another aspect of the present invention.

FIG. 12 is a view showing a structure for mounting a thermostat according to another aspect of the present invention. As shown in FIG. 12, a thermostat 233 is mounted in a water jacket 232 near an intake port 231 of the cylinder head 129 and is covered with an intake manifold 235.

Figure 13:
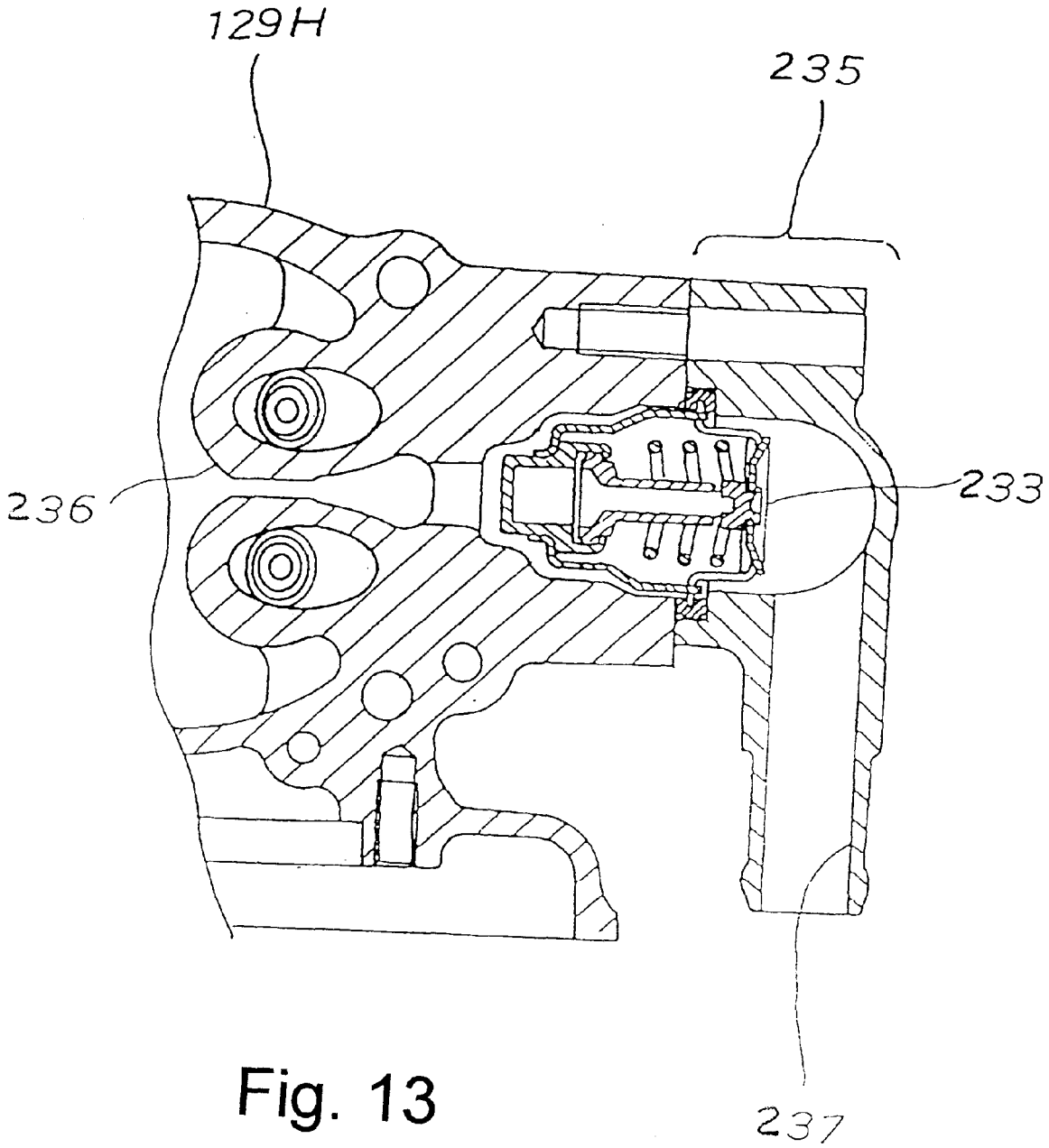
FIG. 13 is a sectional view taken on line 13—13 of FIG. 12.
Figure 14:
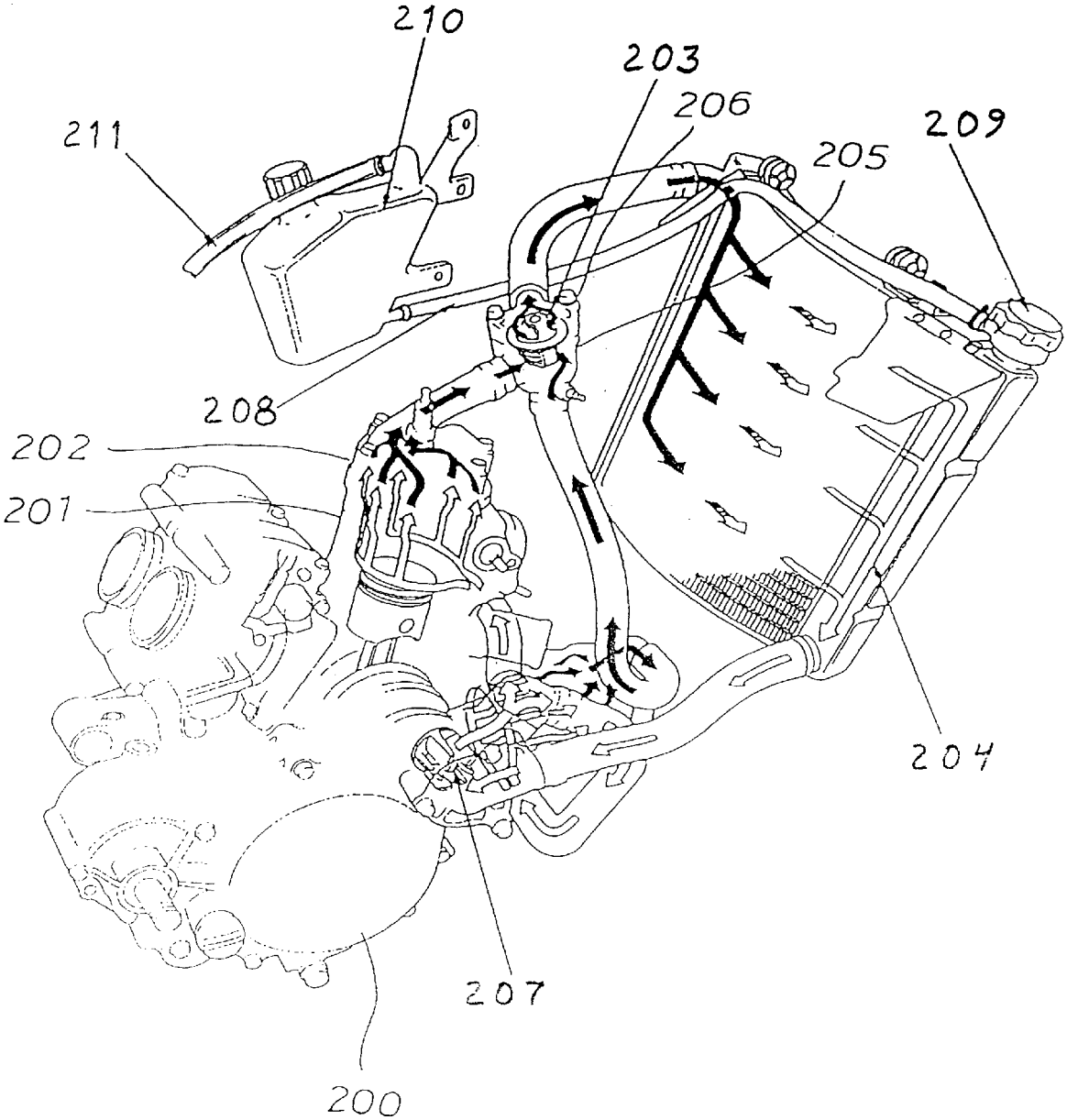
Fig. 14 BACKGROUND ART
FIG. 14 is a view showing one example of a related art cooling water line of a motorcycle.

FIG. 13 is a sectional view taken on line 13—13 of FIG. 12. Referring to FIG. 12, cooling water which has been heated through a water jacket 232 of the cylinder head 129H, that is, hot water passes through the thermostat 233 and it flows from an outlet 237 formed integrally with the intake manifold 235 to the radiator.

Referring to FIG. 12 again, the thermostat 233 is a valve which is closed below a specific temperature and is opened at the specific temperature or more.

When a temperature of water is low, the water flows in the thermostat 233 through small holes 238, passing through a water channel 239 formed in the intake manifold 235, and flows out of the intake manifold 235. Then, the water reaches a hot water riser 241 provided integrally with the carburetor 129C (shown in FIG. 8), to heat the carburetor 129C immediately after start-up to increase the performance of the carburetor 129C.

When the temperature of water becomes high, since the thermostat 233 is opened, the water flows in the thermostat 233 through the small holes 238, and reaches the radiator through the outlet 237. In FIG. 12, character P indicates a pump.

It is to be noted that this aspect of the present invention can be applied not only to a water-cooled engine for a motorcycle but also to a water-cooled engine for a small-sized four wheel car and a specialized water-cooled engine.

The present invention having the above configuration exhibits the following effects:

According to the present invention, since a pump pulley is movable with respect to a cylinder block or a cylinder head, it can serve as a tensioner of a winding means for drive of a cam shaft. Accordingly, it is possible to reduce the number of parts and realize a compact water-cooled four cycle engine suitable for a hybrid type power unit.

According to another aspect of the present invention, since a thermostat is mounted to a cylinder head of a water-cooled engine and is covered with an intake manifold, it is unnecessary to provide a case and a lid for containing the thermostat. Accordingly, it is possible to reduce the number of parts for mounting the thermostat and also to reduce the weight and size of a power unit for a hybrid type engine. Furthermore, since intake air can be heated by a hot water riser, it is possible to enhance engine efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A water-cooled engine comprising:

a cam shaft drive mechanism, said cam shaft drive mechanism including a winding means wound around a cam shaft drive rotator mounted on a crank shaft, said winding means for rotating a cam shaft rotator; and a water pump having a pump chamber, said water pump comprising:

a pump housing, said pump housing including a housing base, mounted on a cylinder block or a cylinder head, said housing base being mounted for movement thereon;

a pump rotor rotatably supported by said housing base; and a housing cover for covering said housing base;

wherein the pump rotor has an impeller disposed in said pump chamber and a pump pulley is connected to said pump rotor, said pump pulley being rotatable by said winding means and movable with said housing base to adjust the tension of said winding means.

2. The water-cooled engine according to claim 1, wherein said pump pulley includes a first magnet mounted thereon for rotation therewith, said pump rotor includes a second magnet thereon for rotation therewith, and wherein when said pump pulley is rotated by said winding means, a rotating magnetic force of the first magnet rotates said second magnet and said pump rotor.

3. The water-cooled engine according to claim 1, further comprising said pump housing having a water inlet and a water outlet, said water outlet being connected to a water inlet of said cylinder block or cylinder head by an eccentric tube fitting.

4. The water-cooled engine according to claim 1, wherein said winding means is a belt, said cam shaft drive rotator is a pulley and said cam shaft rotator is a pulley.

5. The water-cooled engine according to claim 4, wherein there are two of said cam shaft rotator pulleys, a first cam shaft rotator pulley for connecting to an intake cam shaft and a second cam shaft rotator pulley for connecting to an exhaust cam shaft.

6. The water-cooled engine according to claim 1, wherein said housing base includes a shaft portion mounted thereon, said cylinder block or cylinder head includes projecting ribs formed therein, and wherein said shaft portion of said housing base is movably mounted between said projecting ribs.

7. The water-cooled engine according to claim 6, said shaft portion includes a cup rotatably mounted thereon, said pump pulley being mounted on an outer peripheral surface of said cup.

8. The water-cooled engine according to claim 7, further comprising:

a first magnet mounted on an inner peripheral surface of said cup; and a second magnet mounted on said pump rotor, wherein when said pump pulley is rotated by said winding means, a rotating magnetic force of the first magnet rotates said second magnet and said pump rotor.

9. A water-cooled engine comprising:

a cam shaft drive mechanism, said cam shaft drive mechanism including a cam shaft drive rotator, a winding means, and a cam shaft rotator, said winding means transferring rotation of said cam shaft drive rotator to said cam shaft rotator; and a water pump having a pump chamber, said water pump comprising:

a pump housing with a housing base mounted to a cylinder block or a cylinder head, said housing base being mounted for movement thereon; and a pump rotor rotatably supported by said housing base, said pump rotor having an impeller disposed within said pump chamber; and a pump pulley connected to said pump rotor, said pump pulley being rotatable by said winding means of said cam shaft drive mechanism and movable with said housing base to adjust the tension of said winding means.

10. The water-cooled engine according to claim 9, wherein said pump pulley includes a first magnet mounted thereon for rotation therewith, said pump rotor include a second magnet thereon for rotation therewith, and wherein when said pump pulley is rotated by said winding means, a rotating magnetic force of the first magnet rotates said second magnet and said pump rotor.

11. The water-cooled engine according to claim 9, further comprising said pump housing having a water inlet and a water outlet, said water outlet being connected to a water inlet of said cylinder block or cylinder head by an eccentric tube fitting.

12. The water-cooled engine according to claim 9, wherein said winding means is a belt, said cam shaft drive rotator is a pulley and said cam shaft rotator is a pulley.

13. The water-cooled engine according to claim 12, wherein there are two of said cam shaft rotator pulleys, a first cam shaft rotator pulley for connecting to an intake cam shaft and a second cam shaft rotator pulley for connecting to an exhaust cam shaft.

14. The water-cooled engine according to claim 9, wherein said housing base includes a shaft portion mounted thereon, said cylinder block or cylinder head includes projecting ribs formed therein, and wherein said shaft portion of said housing base is movably mounted between said projecting ribs.

15. A thermostat mounting structure for a water-cooled engine comprising:

a cylinder head having a water passage therein;

a thermostat mounted in the water passage of said cylinder head; and an intake manifold for covering said thermostat within said water passage.

16. The thermostat mounting structure for a water cooled engine according to claim 15, wherein a water channel is formed in said intake manifold, hot water passing through said thermostat passes through said water channel to a hot water riser to heat intake air.

17. The thermostat mounting structure for a water-cooled engine according to claim 15, wherein said intake manifold includes a water channel formed therein, said water channel extending from said thermostat to a hot water riser for heating intake air, said intake manifold including an outlet for communicating the thermostat to a radiator of the engine, and wherein said thermostat is mounted at a cylinder head side of said intake manifold.

18. The thermostat mounting structure for a water-cooled engine according to claim 15, wherein said cylinder head and said intake manifold form a thermostat chamber, and said thermostat is mounted in said thermostat chamber.

* * * * *